US007523518B2

(12) United States Patent
Futo et al.

(10) Patent No.: US 7,523,518 B2
(45) Date of Patent: Apr. 28, 2009

(54) PAINTING TRIM TOOL AND TRAY SYSTEM

(75) Inventors: Dennis M. Futo, Strongsville, OH (US); Scott A. Pyle, Vernon Hills, IL (US); Michael M. Sherman, Mooresville, NC (US); James C. Dale, Taylorsville, NC (US)

(73) Assignee: Zibra, LLC, Mooresville, NC (US)

( * ) Notice: Subject to any disclaimer, the term of this patent is extended or adjusted under 35 U.S.C. 154(b) by 668 days.

(21) Appl. No.: 11/214,232

(22) Filed: Aug. 29, 2005

(65) Prior Publication Data

US 2006/0130254 A1 Jun. 22, 2006

Related U.S. Application Data

(60) Provisional application No. 60/670,374, filed on Apr. 12, 2005, provisional application No. 60/638,449, filed on Dec. 22, 2004.

(51) Int. Cl.

| | |
|---|---|
| ***B44D 5/00*** | (2006.01) |
| ***A47L 13/52*** | (2006.01) |
| ***A47L 13/00*** | (2006.01) |
| ***A47L 13/58*** | (2006.01) |
| ***E04F 21/16*** | (2006.01) |
| *B05C 17/02* | (2006.01) |
| *B05C 21/00* | (2006.01) |

(52) U.S. Cl. ..... 15/230.11; 15/257.06; 15/114

(58) Field of Classification Search ..... 15/230.11, 15/257.06, 114

See application file for complete search history.

(56) References Cited

U.S. PATENT DOCUMENTS

| | | | | |
|---|---|---|---|---|
| 2,778,050 A | | 1/1957 | Meinhardt | |
| 2,798,239 A | * | 7/1957 | Freund | 401/15 |
| 2,909,797 A | * | 10/1959 | White | 15/257.06 |
| 2,950,012 A | * | 8/1960 | Mascaretti | 211/65 |
| 3,087,190 A | * | 4/1963 | Werner | 401/121 |
| 3,602,939 A | | 9/1971 | Schoenholz | |
| 3,623,180 A | * | 11/1971 | Anderson | 15/230.11 |
| 3,685,084 A | * | 8/1972 | Bennett | 15/230.11 |
| 3,707,242 A | * | 12/1972 | Golden et al. | 220/570 |
| 3,870,420 A | * | 3/1975 | Hawk | 401/121 |
| 3,947,135 A | * | 3/1976 | Hawk | 401/121 |
| 4,000,537 A | * | 1/1977 | Woo | 15/230.11 |
| 4,012,152 A | * | 3/1977 | Lupkes | 401/218 |

(Continued)

FOREIGN PATENT DOCUMENTS

| | | |
|---|---|---|
| EP | 0 564 362 | 10/1993 |

(Continued)

*Primary Examiner*—Joseph J Hail, III
*Assistant Examiner*—Alvin J Grant
(74) *Attorney, Agent, or Firm*—Wegman, Hessler & Vanderburg

(57) ABSTRACT

A trim tool and paint tray system for use in dispensing paint. The system includes a trim tool having a paint applicator to apply paint to a surface to be painted and at least one edge guard to shield adjacent surfaces that are to remain free of paint from the applicator. The system also includes a paint tray having a paint-receiving well and at least one slot free of paint. The paint tray is configured to receive the trim tool such that the paint applicator is received in the paint well to charge the paint applicator with paint and the edge guard is received in the slot so the edge guard remains free of paint.

20 Claims, 5 Drawing Sheets

U.S. PATENT DOCUMENTS

| | | | | | |
|---|---|---|---|---|---|
| 4,198,723 | A | * | 4/1980 | Hiller et al. | 15/230.11 |
| 4,320,553 | A | * | 3/1982 | Charles | 15/230.11 |
| 4,356,588 | A | | 11/1982 | Martucci | |
| 4,815,604 | A | * | 3/1989 | O'Neil et al. | 206/518 |
| 4,948,078 | A | | 8/1990 | Dumenigo et al. | |
| 5,316,137 | A | * | 5/1994 | Kyllonen | 206/209 |
| 5,473,791 | A | | 12/1995 | Holcomb et al. | |
| 5,509,169 | A | * | 4/1996 | Drucker | 15/257.06 |
| 5,511,279 | A | * | 4/1996 | Ippolito | 15/257.06 |
| 5,735,399 | A | * | 4/1998 | Ste. Marie | 206/362 |
| 5,746,345 | A | * | 5/1998 | Zurawin | 220/735 |
| 6,076,225 | A | | 6/2000 | Sorenson | |
| 6,141,821 | A | * | 11/2000 | Chin | 15/230.11 |
| 6,305,045 | B1 | * | 10/2001 | Walsh et al. | 15/230.11 |
| 6,431,392 | B1 | * | 8/2002 | Eisenbeisz | 220/759 |
| 6,434,782 | B2 | | 8/2002 | Wakat et al. | |
| 6,471,086 | B1 | | 10/2002 | Fleckenstein | |
| 6,493,901 | B1 | * | 12/2002 | Jones | 15/257.06 |
| 6,519,800 | B2 | | 2/2003 | Newman et al. | |
| 6,574,824 | B2 | * | 6/2003 | Burns et al. | 15/230.11 |
| 6,622,884 | B1 | * | 9/2003 | Gartner | 220/570 |
| 6,681,438 | B2 | | 1/2004 | Newman et al. | |
| 6,687,945 | B2 | * | 2/2004 | Robinson | 15/230.11 |
| 6,742,212 | B2 | * | 6/2004 | Pyles | 15/114 |
| 6,925,674 | B2 | * | 8/2005 | Prince et al. | 15/230.11 |
| 2002/0059688 | A1 | | 5/2002 | Wakat et al. | |
| 2003/0012887 | A1 | * | 1/2003 | Orlikowski | 427/428 |
| 2003/0196286 | A1 | * | 10/2003 | Pyles | 15/114 |
| 2003/0200617 | A1 | * | 10/2003 | Pyles | 15/114 |
| 2003/0233721 | A1 | * | 12/2003 | Prince et al. | 15/230.11 |
| 2004/0068814 | A1 | * | 4/2004 | Pyles | 15/114 |
| 2004/0205921 | A1 | | 10/2004 | Woodruff et al. | |
| 2004/0211016 | A1 | * | 10/2004 | Pyles | 15/114 |

FOREIGN PATENT DOCUMENTS

| | | |
|---|---|---|
| WO | WO 99/61262 | 12/1999 |

* cited by examiner

PAINTING TRIM TOOL AND TRAY SYSTEM

REFERENCE TO RELATED APPLICATION

The present application claims priority under 35 U.S.C. §119(e) to U.S. Provisional Patent Application No. 60/638,449, filed Dec. 22, 2004 and entitled "Painting Tools" and U.S. Provisional Patent Application No. 60/670,374, filed on Apr. 12, 2005 and entitled "Painting Apparatus".

BACKGROUND OF THE INVENTION

1. Field of Invention

This invention relates to apparatus useful in painting applications, and more specifically to trim tool for applying paint around trimwork and molding and a paint tray for applying paint to the trim tool.

2. Description of Related Art

There are a variety of painting tools, such as trays, buckets, paint rollers, brushes, pads, and the like for use by painters to make the job of applying paint more efficient. For example, paint trays can be used to provide a reservoir or paint in which to dip a paint tool, be it a trim tool, a paint brush or a paint roller. Typically, the paint trays have been flat, long, horizontal pans or even vertical buckets which have a paint reservoir well and a ribbed angled deck wherein the saturated paint roller is rolled to remove excess paint. These types of paint trays all have a common deficiency—they allow the user to freely dip the paint tool without limitation into the reservoir well. This creates over dipping and over saturation of the paint tool, which increases the mess caused by dripping and paint splatter. Additionally, portions of the paint tool intended to remain free of paint, such as edge guards on trim tools, become contaminated with paint.

This causes many existing trim and edging tools used to prepare the trim surface prior to painting to fail to perform as expected, as the very portions of the trim tool designed to protect adjacent surfaces from being painted actually apply paint to those adjacent surfaces. Thus, charging the trim tool with paint is a problem that leads to getting paint on the very trim work that the trim tool was designed to protect. Additionally, it is often difficult to remove excess paint from the paint applicator portion of the trim tool because the angled deck of generic paint trays can often become saturated with paint and are not specifically designed the smaller trim tools.

Furthermore, with typical paint rollers and trim tools, the painter must handle the paint saturated paint applicator in order to remove it for clean-up or replacement. Thus, they are often messy and cumbersome to use. Thus, there is a need for improved painting tools that provide greater utility and convenience to the user.

Based on the foregoing, it would be desirable to provide a trim tool and paint tray assembly that charges the roller of the trim tool without contaminating guard portions of the tool.

SUMMARY OF INVENTIVE FEATURES

One embodiment of the invention is directed to a trim tool and paint tray system for use in dispensing paint. The system includes a trim tool having a paint applicator to apply paint to a surface to be painted and at least one edge guard to shield adjacent surfaces that are to remain free of paint from the applicator. The system also includes a paint tray having a paint-receiving well and at least one slot free of paint. The paint tray is configured to receive the trim tool such that the paint applicator is received in the paint well to charge the paint applicator with paint and the edge guard is received in the slot so the edge guard remains free of paint.

In another embodiment, the invention is directed to a trim tool and paint tray system for use in dispensing paint. The system includes a trim tool. The trim tool includes a paint applicator to apply paint to a surface to be painted and a tool body that receives the paint applicator. The tool body has a pair of extendable wings, each extendable wing having an edge guard such that the edge guards are positioned along the lateral sides of the trim tool to shield adjacent surfaces that are to remain free of paint. The system also includes a paint tray defining a paint-receiving well and having at least one slot free of paint. The paint tray receives the trim tool such that the paint applicator is received in the paint well to charge the paint applicator with paint and the edge guard is received in the slot so the edge guard remains free of paint.

In another aspect of the invention, the trim tool and paint system has an applicator that has at least one paint roller rotatably and an edge pad mounted on a mounting platform. The edge pad is affixed to the platform along an outer length thereof and applies paint in a gap between an adjacent surface shielded by the adjacent edge guard and the at least one paint roller. The wings are extendable between a first pulled-in position and second extended position, the wings being positioned in the pulled-in condition so that the edge guard at the outer extremity of each wing is positioned adjacent the paint roller or edge pad during painting operations, and the wings being positioned in the extended position to position the edge guard in the slot in the paint tray when charging the applicator with paint. The paint tray has an outer tray base with raised sidewalls forming a paint receiving well. The outer tray base receives a paint roller deck that has raised side portions and a middle portion in fluid communication with the well of the tray base, wherein the slots are located in the raised side portions of the roller deck. The paint roller deck of the paint tray has a paint limiter panel with a grate section, wherein biasing members bias the grate section of the limiter panel upwardly and away from the surface of the paint in the well, and wherein the paint roller is used to push the grate section downward to submerge the grate section into the paint a selected distance such that paint moves through openings in the grate section and comes into contact with the paint roller.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
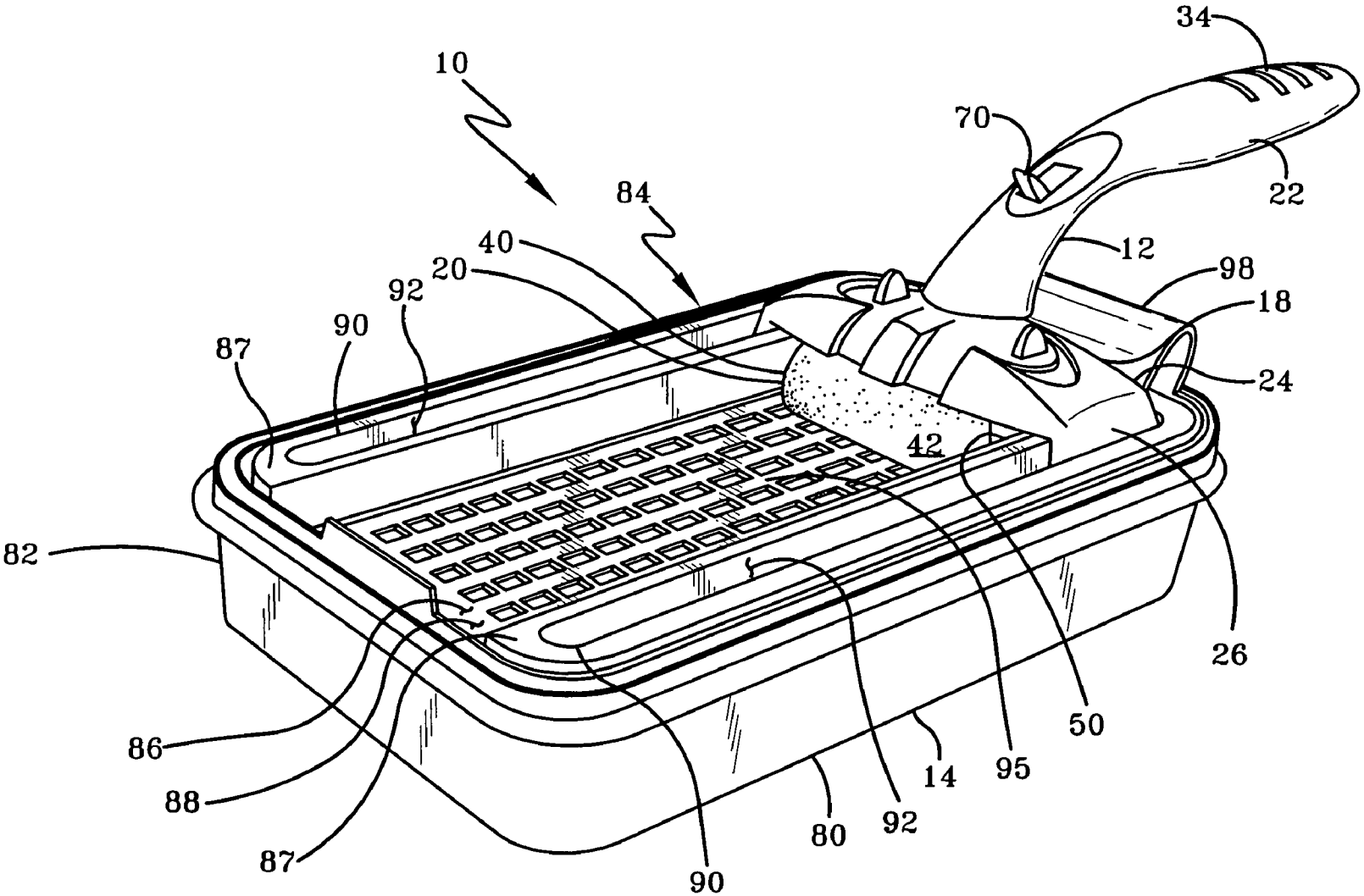
FIG. 1 is a perspective view of a paint trim tool and tray assembly according to an embodiment of the invention.

Referring now to the Figures, FIG. 1 is directed to a paint trim tool and tray system 10 for dispensing paint and paint-like products. The paint tool and tray system 10 comprises a trim or edging tool 12 that quickly and accurately applies paint to a desired surface while protecting adjacent surfaces that are to remain free of paint. A corresponding paint tray 14 receives the trim tool 12 so that paint can be dispensed to the trim tool 12 without getting paint on the portions of the trim tool 12 that are meant to protect the adjacent surfaces as will be described herein.

Figure 2:
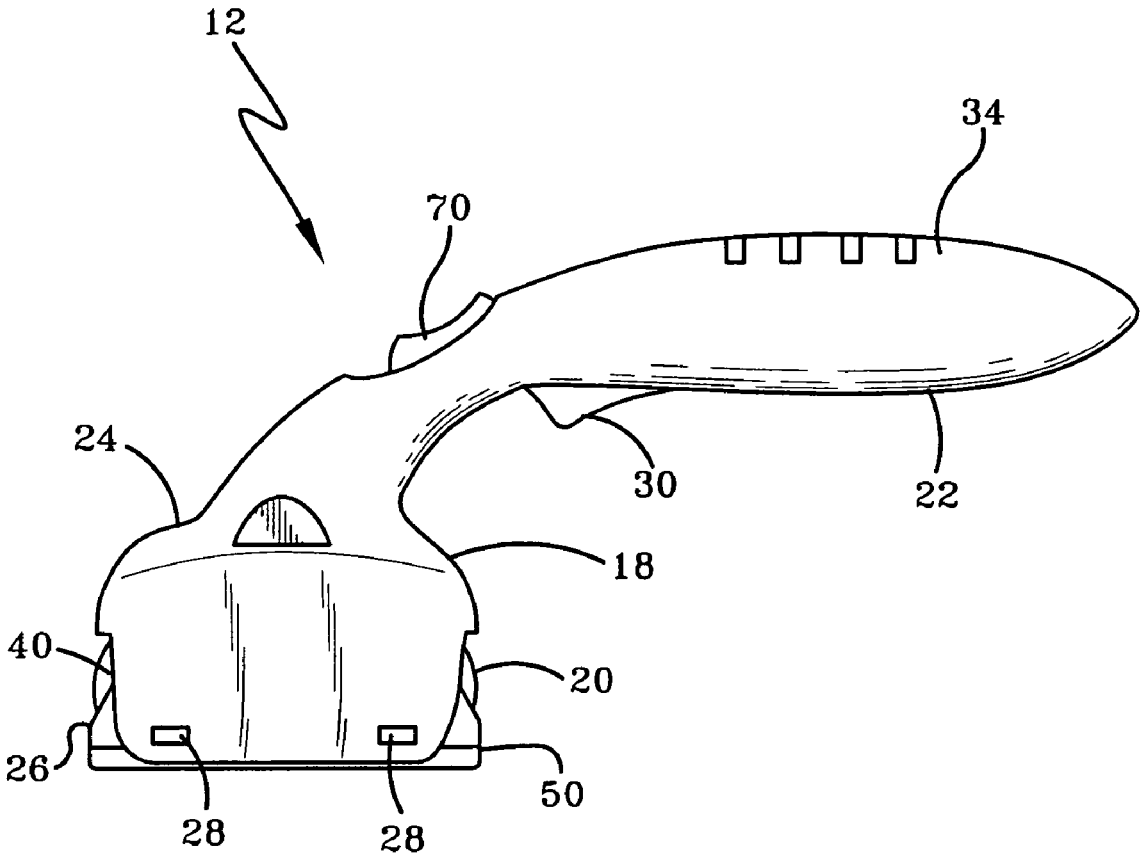
FIG. 2 is a side view of the trim tool of FIG. 1.

The trim tool 12 has a tool body 18 that receives a paint applicator 20 and a handle 22 extending from the tool body 18 that can be grasped by the user so that the paint applicator 20 can be accurately and comfortably guided over the surfaces to be painted. Preferably, the tool body 18 and handle 22 are manufactured from a synthetic polymeric material, such as nylon, polyethylene or other molded plastic. The tool body 18 has a pair of extendable wings 24 leading to edge guards 26 that are positioned along the lateral sides of the trim tool 12 to shield the adjacent surfaces from the paint applicator 20 so that paint is not inadvertently spread to the adjacent surfaces. As seen in FIG. 2, the edge guards 26 contain guide wheels 28 that roll along the adjacent surface so that the trim tool 12 glides over the adjacent surfaces without leaving scrapes or marks. Alternately, the edge guards 26 may have a non-marking bead 29 (FIG. 3) or other structure to facilitate the gliding of the trim tool 12 over the adjacent surfaces.

Figure 3:
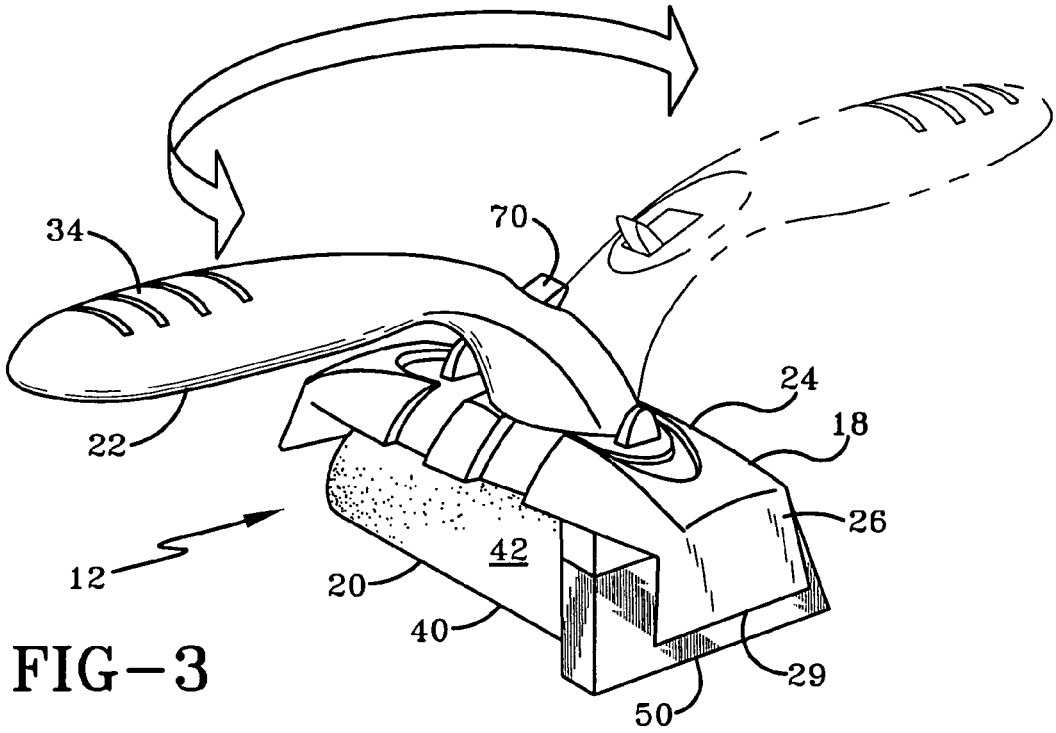
FIG. 3 is a perspective view of the trim tool of FIG. 1 illustrating a swiveling feature of the handle.

Turning now to FIG. 3, in one embodiment, the handle 22 is rotatably connected to the tool body 18. As illustrated, the handle 22 can be rotated 180 degrees with respect to the tool body 14 so that the trim tool 12 can be used against left or right-oriented trim and have the paint applicator 20 abut the trim. A pivot button 30 (FIG. 2) on the handle 22 releases a catch (not shown) to allow the handle 22 to rotate. Other embodiment may allow the handle 22 to also pivot vertically in various positions to allow the user improved leverage than in a fixed position. Desirably, the handle 22 has a soft grip overmold ergonomic handle grip 34 to improve comfort while in use.

Figure 4:
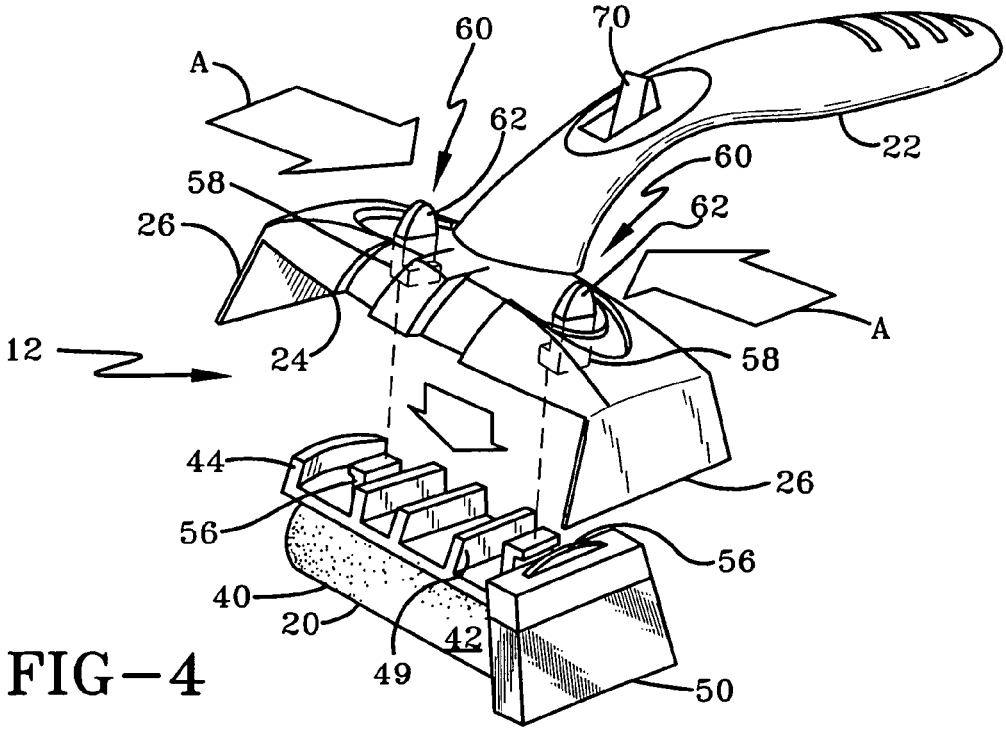
FIG. 4 is a latching mechanism of the trim tool of FIG. 1.
Figure 6:
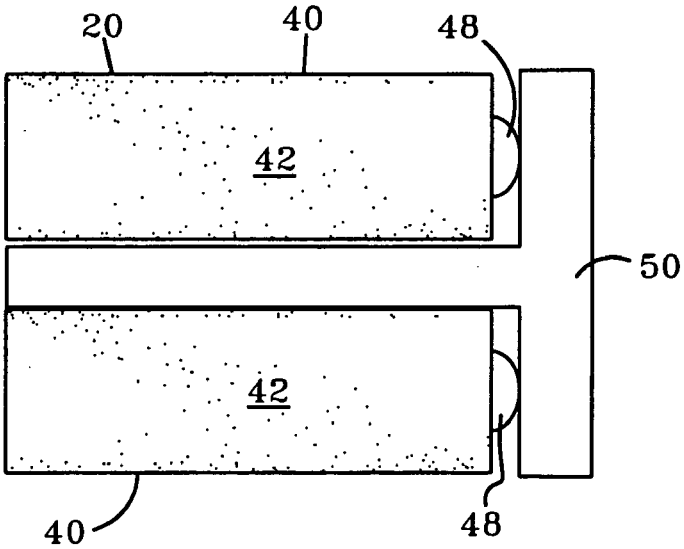
FIG. 6 is a bottom view of the paint rollers of the trim tool of FIG. 1.

Referring now to FIG. 4, the paint applicator 20 desirably contains at least one paint roller 40 rotatably mounted on a mounting platform 44. In one preferred embodiment, the paint applicator 20 contains a pair of paint rollers 40, with the second paint roller 40 positioned behind the first paint roller 40 as illustrated in FIG. 6 to provide improved and faster coverage over the painted surface. As is known, the paint roller 40 has an outer circumferential surface material 42 for carrying paint or other substance to be applied to the work surface. Desirably, the surface material 42 is made of sponge, cotton, synthetic fibers, wool or the like and is highly capable of absorbing the paint or other substance to be applied. Alternately, the applicator 20 may be a foam pad or other suitable paint applicating structure.

Figure 5A:
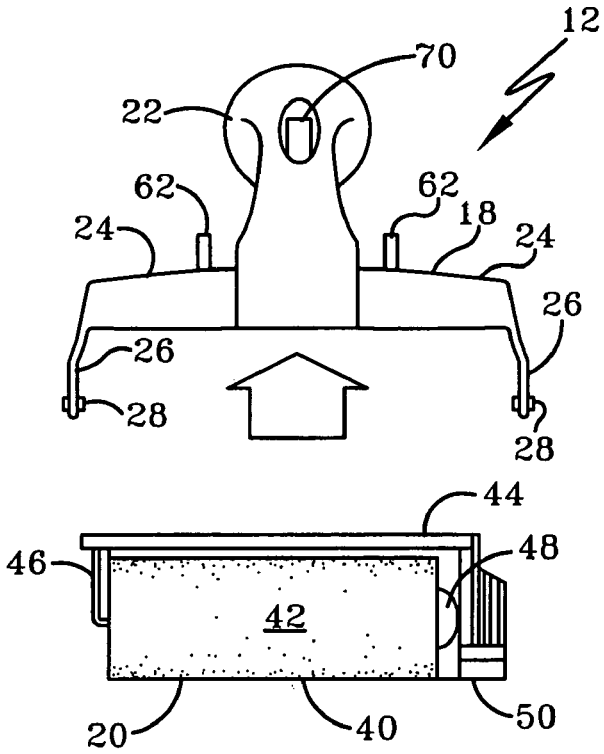
FIGS. 5A and 5B illustrate the latching feature of the trim tool of FIG. 1.
Figure 5B:
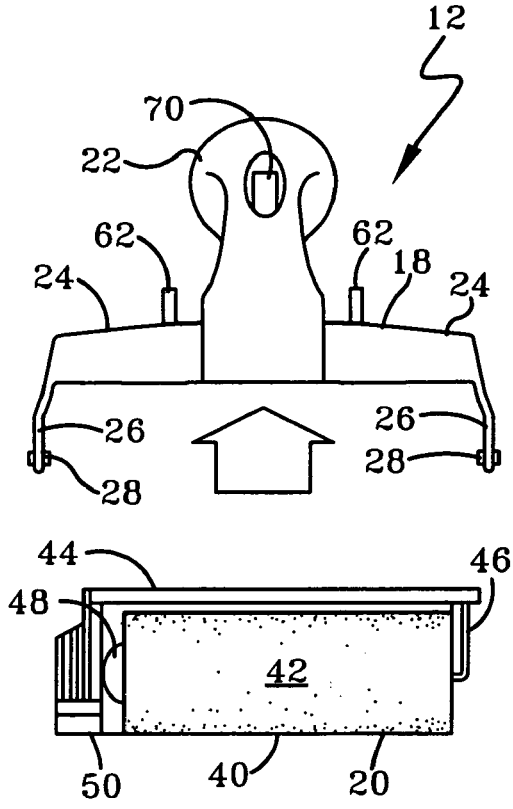

As best seen in FIGS. 5A and 5B, the paint roller 40 is rotatably mounted on the platform 44 with a mounting rod 46 that passes through the tubular paint roller 40 from one end and an end cap 48 disposed and fitted in the opposing end of the paint roller 40. As illustrated the trim tool 12 uses 3-inch paint rollers 40, but other sizes of paint rollers 40 are contemplated without departing from the scope of the invention. The mounting platform 44 has an upper plate with a plurality of ribs 49 to provide a structural support for mounting the paint rollers 40.

Desirably, the paint applicator 20 also contains an edge pad 50. As illustrated, the edge pad 50 is a foam pad capable of absorbing paint and releasing it to the surface to be painted. The edge pad 50 is affixed to the platform 44 along an outer length thereof and applies paint in a gap between the trim or wall edge and where the paint roller 40 begins. Typically, this gap is between about ¼ and 1 inch as the paint roller end cap 48 prevents painting all the way to the wall edge with the paint roller 40. The edge pad 50 extends slightly ahead and slightly behind the front and rear paint rollers 40. Additionally, the edge pad 50 may have a wedge tip to aid in reaching to the corner between the painted surface and the non-painted surface. Alternately, an edge bristle brush or other suitable paint applicating structure can be used for the edge pad 50. The platform 44 desirably can be affixed to the tool body 18 with the edge pad 50 facing either direction as illustrated in FIGS. 5A and 5B so that the trim tool 12 can be set up for right or left oriented trim use independent of swiveling of the handle 22. The applicator 20, including the platform 44, may be made of disposable material, so that the user simply needs to remove and replace the applicator 20 after use to simplify clean-up.

In one embodiment, the trim tool 12 includes a latching mechanism 52 affixing the applicator mounting platform 44 to the tool body 18 that includes a "hands-free" quick-release feature that quickly detaches the platform 44 from the tool body 18. FIG. 4 illustrates the latching mechanism 52 as comprising a pair of receiving/docking catches 56 extending upward from the mounting platform 44 that engage detents 58 on the tool body 18. The latching mechanism 52 further includes an actuator 60 in the form of a pair of platform release squeeze tabs 62, which, when actuated, causes the mounting platform 44 to be decoupled from the tool body 18. The release squeeze tabs 62 are pressed as illustrated by arrows A in FIG. 4 to cause the detents 58, positioned on distal ends of the squeeze tabs 62, to disengage the catches 56 on the platform 44 in order to actuate the release feature. The terms "hands-free" and "quick-release" as used herein with respect to the latching mechanism 52 mean that the decoupling of the applicator 20 from the tool body 18 occurs without requiring the user to apply a manual force directly to the applicator 20. In other words, although a force is required to be applied to the latching mechanism 52 to initiate the decoupling process, the actual force decoupling the applicator 20 from the tool body 18 is provided by means other than manual force applied by the user to the applicator 20. The squeeze tabs 62 on the tool body 18 are used to eject the mounting platform 44 so that the applicator 20 can be disconnected or replaced with ease. The disconnect function allows the user to do so without touching the applicator 20, eliminating the mess. Although the embodiment in FIGS. 4 and 5 illustrates one mechanism and method for latching the platform 44 and actuating the latching mechanism 52, other means resulting in hands-free removal may be used using sound engineering judgment without departing from the scope of the invention. For example, a latching mechanism (not shown) can latch the handle 12 to the tool body 14 and the entire tool body 14, including the wings 24 and edge guards 26, can be release with the applicator 20 and replaced. In this system, only the handle 12 would remain after disengagement and be made of non-disposable material.

The wings 24 of the tool body 18 extend outward along the axis of the paint roller 40. A push spring-release extension trigger 70 on the handle 22 controls the movement of the wings 24 between a retracted or pulled-in condition and an extended condition. For painting operations, the wings 24 are positioned in the pulled-in condition so that the edge guard 26 at the outer extremity of each wing 24 is positioned adjacent the paint roller 40 or edge pad 50. This enables the edge pad 50 to apply paint to the surface to be painted up to the edge guard 26. However, to aid in recharging the paint roller 40 and edge pad 50 with paint without contaminating the edge guards 26, the wings 24 are positioned in the extended position for use with the paint tray 14 as will be discussed below so that the edge guards 26 don't become contaminated with paint.

Returning again to FIG. 1, the paint tray 14 used in conjunction with the trim tool 12 will now be described. The paint tray 14 has an outer tray base 80 with raised sidewalls 82 forming a paint receiving well 84. The outer tray base 80 receives a paint roller deck 86 that has raised side portions 87 and a middle portion 88 in fluid communication with the well 84 of the tray base 80. As shown in FIG. 1, the paint roller deck 86 has a pair of slots 90 in the raised side portions 87 running along either side of the paint well 84. The slots 90 are formed with inner wall dams 92 that prevent the paint in the paint well 84 from entering the slots 90. In use, when charging the applicator 20 with paint, the wings 24 are extended to the outward configuration. With the wings 24 in the outward or extended position, the trim tool 12 docks in the paint tray 14 so that paint can be applied to the paint roller 40 and edge pad 50. When dipping the paint roller 40 and edge pad 50 in the paint well 84, the edge guards 26 of the trim tool 12 track in the slots 90 so that the edge guards 26 remain free of paint. After the trim tool 12 is charged with paint, the wings 24 can be returned back to the pulled-in configuration for painting operations.

Figure 7A:
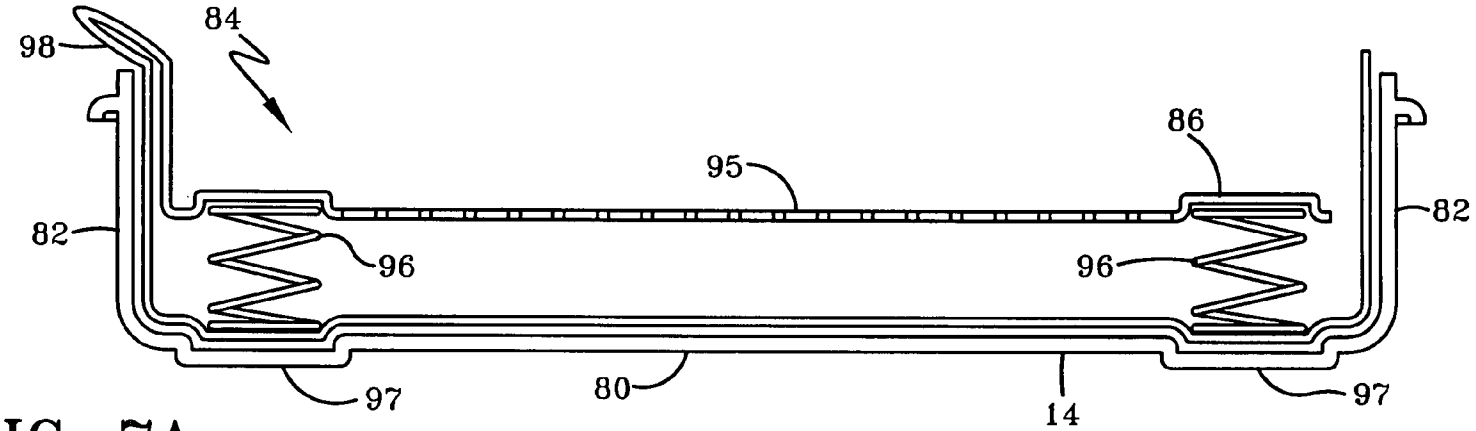
FIGS. 7A and 7B are sectional views of the paint tray of the assembly of FIG. 1 illustrating a paint limiter feature of the tray.
Figure 7B:
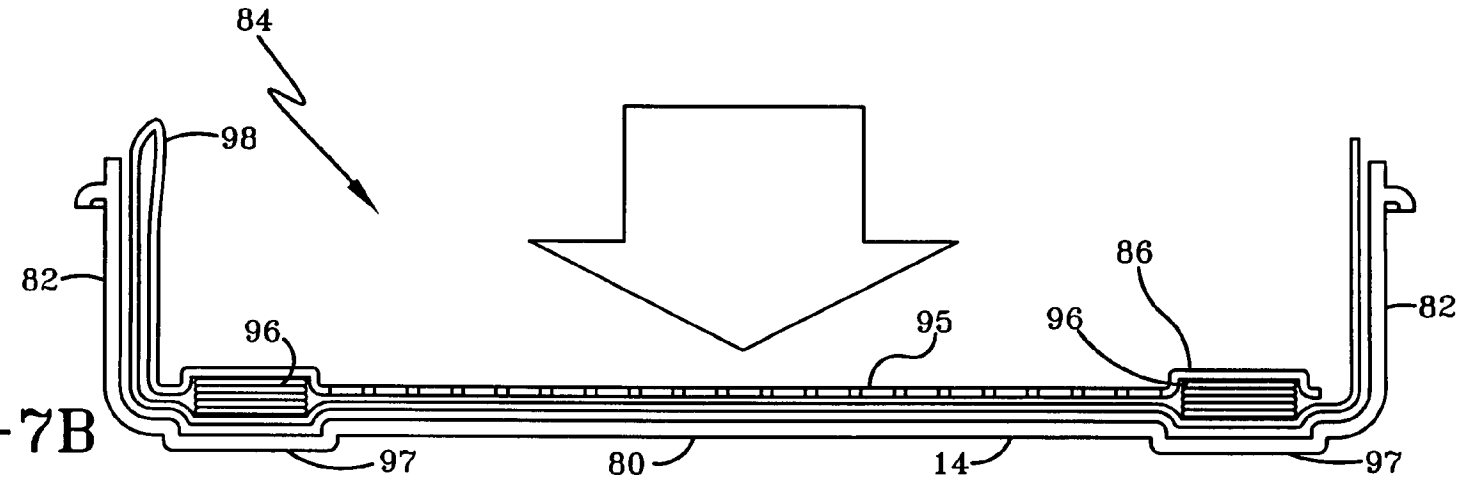

In one embodiment, as best seen in FIGS. 7A and 7B, the paint roller deck 86 of the paint tray 14 has a paint limiter panel 94 with a grate section 95. Biasing members, such as springs 96, bias the grate section 95 of the limiter panel 94 upwardly and away from the surface of the paint in the well 84. The paint roller 40 is used to push the grate section 95 downwardly while being rolled across the top of the grate section 95 to submerge the grate section 95 into the paint a short distance. When the downward pressure from the paint roller 40 is substantially removed from the grate section 95, the springs 96 bias the grate section 95 into an elevated position above the paint level in the well 84. Desirably, the springs 96 are sized such that when the springs 96 are fully compressed, they allow the limiter panel 94 to bottom out in the against the tray base 80. In one embodiment, the tray base 80 has molded feet 97. The molded feet 97 provide recesses with internal bosses to register and trap the springs 96 and prevent the springs 96 from leaning or migrating under pressure during use.

As seen in FIG. 7A, in one embodiment the paint roller deck 86 and the tray are formed as a single polypropylene part featuring a living hinge 98. As best seen in FIG. 7B, the elongated living hinge 98 allows the limiter panel 94 to travel up and down inside the well 84 to reach the paint level. In operation, the springs 96 act as biasing means for holding the grate section 95 upwardly and out of paint contained in the well 84. When charging a paint roller 40 in the paint, the paint roller 40 is pressed against the grate section 95, which is rigid or flexible, to move the grate section 95 against the bias of springs 96 into engagement with a level of paint in the container. The paint then moves through openings in the grate section 95 and comes into contact with the paint roller 40. The paint roller 40 is moved across the grate section 95 to provide an even distribution of paint on the paint roller 40.

In one embodiment, the paint tray system 10 includes an optional snap-on lid (not shown) that covers the open well 84 of the paint tray 14 to cover the paint during breaks in painting and reduce spillage during transport of the paint tool and tray system 10. The lid desirably has a recess for storing the trim tool 12.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A trim tool and paint tray system for use in dispensing paint, the system comprising:

a trim tool having a paint applicator to apply paint to a surface to be painted and at least one edge guard to shield adjacent surfaces that are to remain free of paint from the applicator; and a paint tray having a paint-receiving well and at least one slot free of paint, wherein the paint tray receives the trim tool such that the paint applicator is received in the paint well to charge the paint applicator with paint and the edge guard is received in the slot so the edge guard remains free of paint.

2. The system of claim 1, wherein the trim tool comprises a tool body that receives the paint applicator and a handle extending from the tool body, wherein the tool body has a pair of extendable wings, each extendable wing comprising one of the at least one edge guards such that the edge guards are positioned along the lateral sides of the trim tool to shield adjacent surfaces from the paint applicator.

3. The system of claim 2, wherein the edge guards contain guide wheels that roll along adjacent surface so that the trim tool glides over the adjacent surfaces.

4. The system of claim 2, wherein the handle is rotatably connected to the tool body such that the handle can be rotated 180 degrees with respect to the tool body so that the trim tool can be used against left or right-oriented trim and have the paint applicator abut the trim.

5. The system of claim 1, wherein the paint applicator comprises at least one paint roller rotatably mounted on a mounting platform.

6. The system of claim 5, wherein the paint applicator comprises first and second paint rollers, with the second paint roller positioned behind the first paint roller.

7. The system of claim 5, wherein the paint applicator further comprises an edge pad, wherein the edge pad is affixed to the platform along an outer length thereof and applies paint in a gap between the adjacent surface and the paint roller.

8. The system of claim 7, wherein the edge pad extends slightly ahead and slightly behind first and second paint rollers.

9. The system of claim 2, wherein the trim tool comprises a latching mechanism affixing the mounting platform to the tool body and an actuator having a quick-release mechanism that detaches the platform from the tool body.

10. The system of claim 9, wherein the latching mechanism comprising a pair of docking catches extending upward from the mounting platform that engage detents on the tool body, and wherein the actuator has a pair of platform release squeeze tabs, which, when actuated, causes the mounting platform to be decoupled from the tool body.

11. The system of claim 2, wherein the wings are extendable between a first pulled-in position and second extended position such that the wings move in opposite directions away from the paint applicator along an axis of rotation of said paint applicator, the wings being positioned in the pulled-in condition so that the edge guard at the outer extremity of each wing is positioned adjacent the paint roller or edge pad during painting operations, and the wings being positioned in the extended position to position the edge guard in the slot in the paint tray when charging the applicator with paint.

12. The system of claim 1, wherein the paint tray has an outer tray base with raised sidewalls forming a paint receiving well, wherein the outer tray base receives a paint roller deck that has raised side portions and a middle portion in fluid communication with the well of the tray base, wherein the slots are located in the raised side portions of the roller deck with inner wall dams that prevent paint in the paint well from entering the slots.

13. The system of claim 12 wherein the paint roller deck of the paint tray has a paint limiter panel with a grate section, wherein biasing members bias the grate section of the limiter panel upwardly and away from the surface of the paint in the well, and wherein the paint roller is used to push the grate section downward to submerge the grate section into the paint a selected distance such that paint moves through openings in the grate section and comes into contact with the paint roller.

14. The system of claim 13, wherein the paint roller deck and the tray base are formed as a single polypropylene part featuring a living hinge.

15. A trim tool and paint tray system for use in dispensing paint, the system comprising:

a trim tool, the trim tool comprising:

a paint applicator to apply paint to a surface to be painted;

a tool body that receives the paint applicator, wherein the tool body has a pair of extendable wings, each extendable wing comprising an edge guard such that the edge guards are positioned along the lateral sides of the trim tool to shield adjacent surfaces that are to remain free of paint;

a handle extending from the tool body; and a paint tray defining a paint-receiving well and having a pair of slots on opposing sides of the paint receiving well, said slots being free of paint, wherein the paint tray receives the trim tool such that the paint applicator is received in the paint well to charge the paint applicator with paint and each edge guard is received in one of the slots so the edge guards remains free of paint.

16. The system of claim 15, wherein the paint applicator comprises at least one paint roller rotatably and an edge pad mounted on a mounting platform, wherein the edge pad is affixed to the platform along an outer length thereof and applies paint in a gap between an adjacent surface shielded by the adjacent edge guard and the at least one paint roller.

17. The system of claim 16 wherein the trim tool comprises a latching mechanism affixing the mounting platform to the tool body and an actuator having a quick-release mechanism that detaches the platform from the tool body, wherein the latching mechanism comprising a pair of docking catches extending upward from the mounting platform that engage detents on the tool body, and wherein the actuator has a pair of platform release squeeze tabs, which, when actuated, causes the mounting platform to be decoupled from the tool body.

18. The system of claim 15, wherein the wings are extendable between a first pulled-in position and second extended position, the wings being positioned in the pulled-in condition so that the edge guard at the outer extremity of each wing is positioned adjacent the paint roller or edge pad during painting operations, and the wings being positioned in the extended position to position the edge guard in the slot in the paint tray when charging the applicator with paint.

19. The system of claim 15, wherein the paint tray has an outer tray base with raised sidewalls forming a paint receiving well, wherein the outer tray base receives a paint roller deck that has raised side portions and a middle portion in fluid communication with the well of the tray base, wherein the slots are located in the raised side portions of the roller deck, and wherein the paint roller deck of the paint tray has a paint limiter panel with a grate section, wherein biasing members bias the grate section of the limiter panel upwardly and away from the surface of the paint in the well, and wherein the paint roller is used to push the grate section downward to submerge the grate section into the paint a selected distance such that paint moves through openings in the grate section and comes into contact with the paint roller.

20. A method for charging a trim tool with paint from a paint-receiving well in a paint tray, the trim tool comprising a rotatable paint applicator to apply paint to a surface to be painted and a tool body that receives the paint applicator, wherein the tool body has at least one extendable wing comprising an edge guard, such that the edge guard is positioned to shield an adjacent surface that is to remain free of paint, and the paint tray has a paint-receiving well and at least one slot free of paint, the method comprising:

extending the at least one wing to an extended outward configuration such that the at least one wing moves away from the rotatable paint application along the axis of rotation of said paint applicator;

docking the trim tool in the paint tray such that the paint applicator is received in the well and the at least one edge guard is received in the at least one paint-free slot;

moving the trim tool in the paint tray to charge the applicator with paint while the at least one edge guard tracks in the slot so that the edge guard remains free of paint;

removing the trim tool from the paint tray; and retracting the at least one wing to a pulled-in configuration so that the edge guard is adjacent the paint applicator.

* * * * *